US006886577B1

(12) United States Patent
Phillips et al.

(10) Patent No.: US 6,886,577 B1
(45) Date of Patent: May 3, 2005

(54) PRODUCT IDENTIFICATION RINGS FOR BELOW GROUND STORAGE TANKS

(75) Inventors: Paul E. Phillips, Whitehall, MI (US); Elmer P. Klop, Grand Haven, MI (US)

(73) Assignee: EBW, Inc., Muskegon, MI (US)

( * ) Notice: Subject to any disclaimer, the term of this patent is extended or adjusted under 35 U.S.C. 154(b) by 0 days.

(21) Appl. No.: 10/442,725

(22) Filed: May 21, 2003

Related U.S. Application Data

(60) Provisional application No. 60/398,976, filed on Jul. 26, 2002.

(51) Int. Cl.[7] ..... E03B 1/00; E02D 29/14

(52) U.S. Cl. ..... 137/15.01; 137/364; 137/371; 137/559; 404/25

(58) Field of Search ..... 404/25; 137/363, 137/364, 371, 559, 234.6, 15.01

(56) References Cited

U.S. PATENT DOCUMENTS 4,818,151 A * 4/1989 Moreland ..... 405/303
4,973,191 A * 11/1990 Dannhauser ..... 404/25
5,141,020 A 8/1992 Sunderhaus et al. ..... 137/467
5,160,064 A 11/1992 LeBlanc ..... 220/644
5,842,811 A * 12/1998 Johnson ..... 404/25
6,036,401 A 3/2000 Morina et al. ..... 404/26
6,336,422 B1 1/2002 Peters ..... 116/200

* cited by examiner

*Primary Examiner*—A. Michael Chambers
(74) *Attorney, Agent, or Firm*—Young & Basile, P.C.

(57) ABSTRACT

A colored ring immovably associated with an inlet of an underground tank to enhance the identification of the material in the underground tank. The ring can be bolted to the inlet or engaged with adhesive to the inlet. The ring can be formed as a substantially continuous ring or a plurality of ring members. The ring can be partially positionable in the ground or can be fully disposed above ground. The ring can include a colored surface or can be uniformly colored. The ring can be used in combination with a colored lid such as the color of the lid and the color of the ring are substantially similar.

20 Claims, 2 Drawing Sheets

PRODUCT IDENTIFICATION RINGS FOR BELOW GROUND STORAGE TANKS

CROSS-REFERENCE TO RELATED APPLICATIONS

This application claims the benefit of the provisional patent application 60/398,976 for a PRODUCT IDENTIFICATION RINGS FOR BELOW GROUND STORAGE TANKS, filed on Jul. 26, 2002, the content of which is hereby incorporated by reference. This claim is made under 35 U.S.C. §119(e) and 37 C.F.R. 1.53(c)(3).

FIELD OF THE INVENTION

The invention relates to a product identification ring for below ground storage tanks.

BACKGROUND OF THE INVENTION

In a typical service station there are several underground or below ground storage tanks, each tank for a different type of fuel. Fuel is directed to each tank through an opening at ground level. The opening is enclosed by a removable access cover. Access covers can be colored to prevent cross-contamination of different types of fuel. For example, a yellow cover may correspond to diesel fuel and a red cover may correspond to high octane gasoline. The coloring of the access cover can be integral with the access cover or the access cover can be painted.

SUMMARY OF THE INVENTION

The present invention provides an apparatus and method for identifying material contained in an underground storage tank. The invention includes a colored ring substantially permanently mounted to an inlet of an underground storage tank. A cover of the inlet can be removed while the ring of the present invention remains associated with the inlet of the tank to enhance the likelihood that the type of fuel contained in the tank can be identified.

The ring can be a substantially continuous ring with a slit joint. In such an embodiment of the invention, the ring can be engaged with respect to the inlet in a manner somewhat similar to the engagement of a key with a key ring. Alternatively, the ring can be formed from two or more ring members. The ring members can be disposed partially or completely around the inlet. The ring can be engaged to the inlet with adhesive or with one or more bolts. The ring can be mounted underneath a portion of the inlet such that the inlet is positioned between the base plate and the ring. Alternatively, the ring can be mounted on the base plate such that base plate is positioned between the ring and inlet. The ring can be partially positioned in the ground or be positioned completely above ground. For example, a portion of the ring can be positioned underground to enhance the stability of the ring. The ring can be colored on one surface or can be uniformly colored.

The invention also provides that the ring can be used in combination with a colored lid. The lid can be colored similarly as the ring. The combination of the colored ring and a color lid can enhance the likelihood that the fuel in the below ground container can be accurately identified.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

The present invention addresses the aforementioned concerns. The solution to the problem of corresponding the correct color lid with the correct type of fuel in the underground storage tank is to place a color coded ring made out of plastic around the outside of the lid pocket.

The remedy to identify multiple underground storage tanks for different types of fuels is provided with two options. The first option is to incorporate a color ring which is incorporated to the outside of the lid pocket during the manufacturing process. The second option is to provide a remedy for existing underground storage tanks. The remedy includes providing a plastic ring that is glued to the ring pocket as a retrofit.

Figure 1:
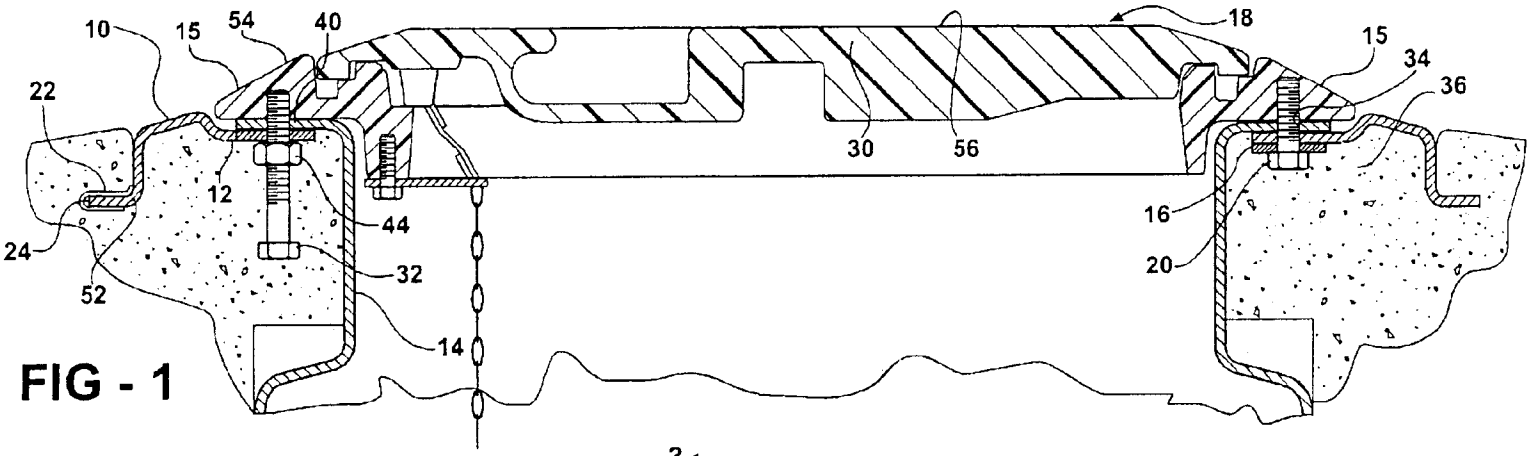
FIG. 1 is a sectional view of a below ground storage tank having a product identification ring thereon according to the present invention.
Figure 3:
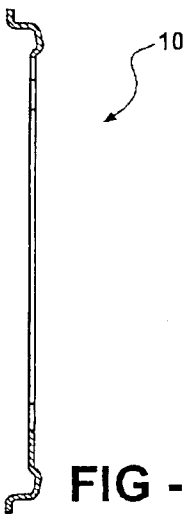
FIG. 3 is a sectional view of the product identification ring shown in FIG. 2.
Figure 2:
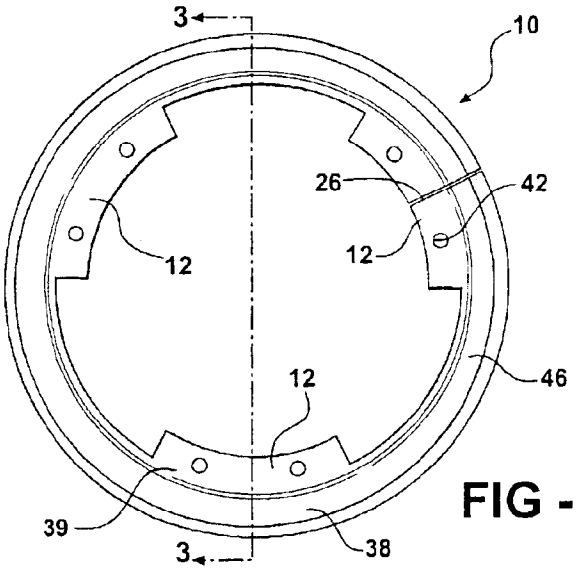
FIG. 2 is a top planar view of the product identification ring.
Figure 1A:
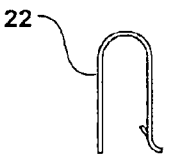
FIGS. 1A and 1B are views of the spring clip for the product identification ring.
Figure 1B:
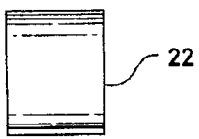

FIGS. 1 through 3 show the first embodiment of a fuel containment cover ID ring for a new installation. FIG. 2 shows a plan view of the ID ring. The ID ring 10 is color coded. The color coded ID ring 10 has three interior tabs 12 for alignment to secure to the tank 14. The ID ring has a split joint 26 for the assembly process. To install a color product ID ring, the three backup plates 16 are removed from the fuel containment cover assembly and the associated bolts are discarded that were used for the backup plates 16. The color ID ring 10 is then threaded onto the spill container 18 similar to a key onto a key ring. The color ID ring 10 is rotated until the three tabs 12 are in position where the three backup plates 16 were removed. Once the color ID ring 10 is in position, the backup plates 16 are then placed over the colored ID ring tabs 12 and secured with new longer bolts 20 to attach the ID ring 10 with the backup plates 16 together and tank 14 to snow plow guard ring 15. Spring clip 22 is then installed on the edge 24 of the ring 10 at the split joint 26 in order to hold the ID ring 10 together until concrete has set. A spring clip 22 is shown in FIGS. 1A and 1B.

Figure 5:
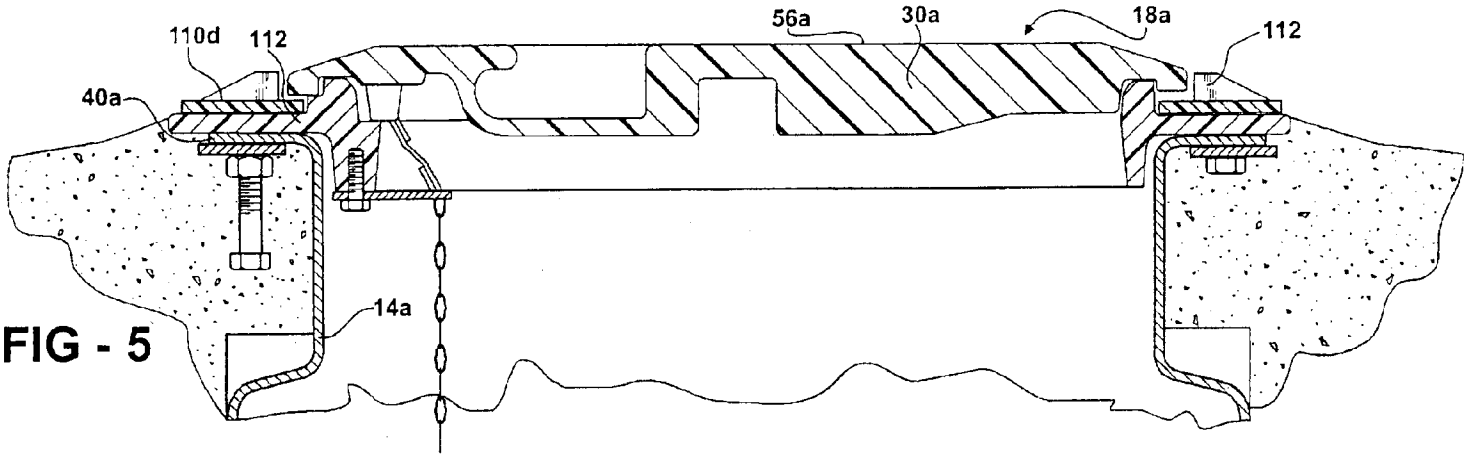
FIG. 5 is a side sectional view of the plastic ring in FIG. 4 on the existing tank system.
Figure 6:
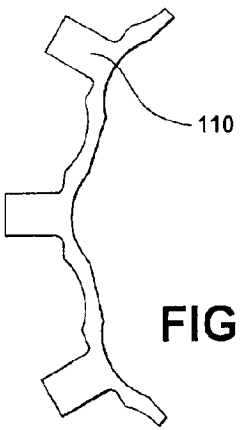
FIG. 6 is a top planar view of a segment of a ring member.
Figure 4:
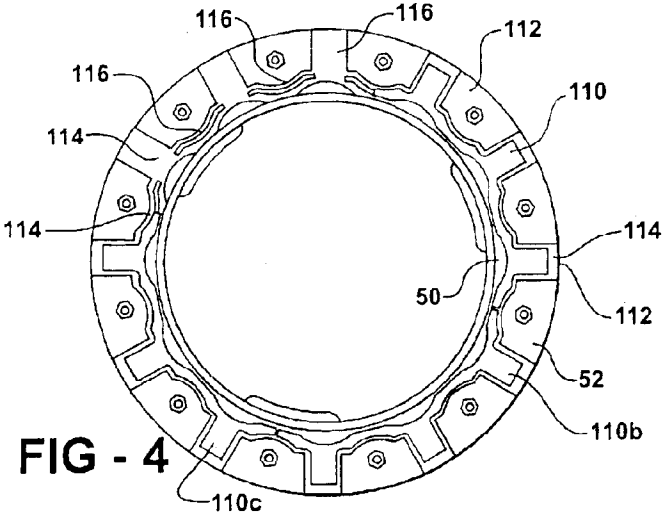
FIG. 4 shows a plurality of ring members engaged with a base plate.

FIGS. 4–6 show an alternative embodiment wherein the colored product ID ring or ring member 110 is a retrofit to an existing fuel containment cover assembly or base plate 112. FIG. 4 shows the configuration of the retrofitted color ID ring segments 110, with one segment deleted to show an adhesive pattern 116 used to securely attach the ring segments 110 to the cover assembly 112.

To install the retrofit colored product ID ring 110, the rain drainage groove 114 of the cover assembly 112 must be cleaned of any loose paint, excess concrete, sand or other debris. After cleaning the rain drainage groove 114, a ⅛ inch bead of construction adhesive 116 is applied into the groove 114 in a pattern similar to that shown in FIG. 4. Each ring segment 110 is pressed onto the adhesive 116 and positioned to get good contact between the adhesive 116 and segments 110.

Figure 7:
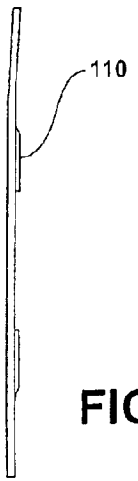
FIG. 7 is a side view of a segment of the ring member of FIG. 6.

FIG. 5 shows a sectional view of the existing fuel containment cover assembly 112 with a retrofit colored product ID ring 110 thereon. As can be seen in FIGS. 5 and 7, the ring 110 is narrow relative to the cover assembly 112 and does not interfere with the function of the cover assembly 112.

FIG. 6 shows the configuration of a segment of the retrofit colored product ID ring 110. Preferably four segments or ring members provide the entire circular ring 110 when secured to the cover assembly 112.

The aforementioned embodiment provide a durable means for identifying the different underground storage tanks.

The present invention provides an apparatus and method for identifying material contained in an underground tank, the storage tank having a spill container defining an inlet of the storage tank. Referring now to FIG. 1, a grade level spill container 18 is shown in cross-section. The container 18 includes one or more clamp plates 16 immovably associated with a tank 14 and snow plow ring 15 with bolts, such as bolt 20 passing through aperture 34 defined by the tank 14. During construction of the underground tank and spill container 28, bolts such as bolt 20 are passed through aperture 34 and threadingly engaged with one or more clamp plates. After the one or more clamp plates 16 are immovably associated with the ring 15, concrete 36 can be dispensed around the spill container 28. Where the invention is retrofit with respect to a previously assembled below ground fuel tank inlet assembly, the concrete 36 can be removed with respect to spill container 28 and the one or more clamp plates 16 can be disengaged with respect to the tank 14 by removing the bolts 20.

In one embodiment of the invention, colored means can be a substantially continuous ring 10 engagable with the tank 14 of the spill container 28. Where the ring 10 is retrofit with respect to a previously assembled below ground fuel tank inlet assembly, concrete 36 can be removed and the one or more base plates 16 can be removed with respect to the tank 14. The ring 10 can be slightly bent or deformed such that portions 38 and 39, on opposite sides of the split joint 26, are moved away from one another. One of the portions 38, 39 is positioned under a snow plow ring 15 of the tank 14. The ring 10 can be rotated around the tank 14 so that the ring 10 can be positioned under the ring 15. In particular, as the ring 10 is rotated about the tank 14 an increasing length of the ring 10 extending from the portion 38 to the portion 39 is moved beneath or below ring 15 until the portion 39 is disposed under the ring 15. After both portions 38, 39 are disposed beneath the ring 15, the ring 10 can be rotated about the tank 14 to align apertures 42 defined by tabs 12 with apertures 34 defined by the ring 15. When the apertures 42 and 34 are aligned, the one or more base plates 16 can be positioned on an opposite side of the ring 15 with respect to the ring 10 and the bolts 20 can be threadingly received by the one or more clamp plates 16. A spring clip 22 can be positioned over the split joint 26 to enhance the rigidity of the ring 10 after engagement of the ring 10 with the tank 14 and during the pouring of concrete 36 around the tank 14 and ring 15.

The ring 10 includes at least one colored surface 46 exposed or visible with respect to the environment. As shown in FIG. 1, the ring 10 can also include at least a portion 52 positionable in the ground or the concrete. The surface 46 can be substantially parallel and coplanar to a surface 54 of the ring 15. The surface 54 can be desirable to prevent damage to the ring 15 by a snowplow. The surface 46 can be formed to correspond to the surface 54, such that the surface 54 is extended or elongated.

Colored ring 10 can eliminate the need to paint ring 15, usually made of cast iron, every couple months. Ring 10 can be molded polyethylene with color all the way through. Polyethylene can be desirable because of it is resistant to gasoline and other fuels. The ring 10 can be produced by many different processes including injection molding, compression molding, and vacuum forming. When vacuum forming is used, a sheet of polyethylene can be warmed in an oven and then placed into a mold. A vacuum can then be applied to form the sheet of polyethylene as desired to form the ring 10.

In a second embodiment of the invention shown in FIGS. 5–7, a grade level spill container 18*a* can include a base ring 112 immovably associated with a tank 14*a*. The construction and assembly of the base ring 112 with the tank 14*a* is substantially similar to a construction or assembly of the ring 15 with the tank 14. In the second embodiment of the invention, colored means can include a plurality of ring members 10 engagable with the base ring 112 of the spill container 18*a* The base rings 112 can define a groove or recess 114. As shown in FIG. 4, the ring members 110*a*–110*c* can be positionable with respect to the recess 114. The ring members 110*a*–110*c* can be immovably associated with the base rings 112 with the adhesive 116. As shown in FIG. 5, the ring member 110*d* is positionable adjacent and opposite side of the base ring 112 with respect to a lid 40*a* of the tank 14*a*. The ring member 110*d* can be fully disposed on the spill container 18*a* and not extendable with respect to the ground.

The ring member 110 can be formed from any poly material. The ring member 110 can be formed from nylon, acetyl and polyethylene with or without glass fibers and/or additives. The ring member 110 can be uniformly colored, such that the ring member 110 is colored throughout the depth of the ring member 110. In addition, the ring member 110 can be arcuately shaped to correspond to an outer surface of the base plates 112. Specifically, the ring member 110 can be formed as a truncated, hollow and partial cone to substantially conform to a profile of the base plate 112.

The invention can also include a colored lid removably engageable with the spill container where the color of the lid is substantially the same as the color of colored means. For example, in FIG. 1 the surface 46 can display similar color as a color of a surface 56 of the lid 30. Similarly, referring to FIG. 5, the ring member 110*d* can be the same color as a surface 56*a* of the cover 30*a* Alternatively, the cover engageable with the spill container can be a different color with respect to the colored means.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method for identifying material contained in an underground storage tank, the storage tank having a spill container defining an exposed inlet of the storage tank and a lid removably attached to the inlet, the method comprising the step of:

rigidly associating a colored means with the inlet of the underground storage tank, leaving at least a portion of the colored means exposed to enable the colored means to be viewed from an exterior of the spill container when the lid is attached to the inlet of the storage tank.

2. The method of claim 1 wherein the associating step further comprises the step of:

immovably associating said colored means with respect to a base plates of the spill container with at least one bolt.

3. The method of claim 1 wherein the associating step further comprises the step of:

immovably associating said colored means with respect to a base plates of the spill container with adhesive.

4. The method of claim 1 further comprising the step of:

removably engaging a colored lid with respect to the spill container, wherein a color of the colored lid is substantially the same as a color of colored means.

5. The method of claim 1 further comprising the step of:

forming colored means as one of a plurality of ring members engageable with a base plate of the spill container and a substantially continuous ring engageable with a skirt of a spill container.

6. An apparatus for identifying material contained in an underground storage tank, the storage tank having a spill container defining an exposed inlet of the storage tank and a lid removably attached to the inlet, the apparatus comprising:

colored means rigidly associated with the inlet of the underground storage tank, the colored means being viewable from an exterior of the spill container when the lid is attached to the inlet of the storage tank.

7. The apparatus of claim 6 wherein colored means further comprises:

a plurality of ring members engageable with a base plates of the spill container.

8. The apparatus of claim 6 wherein colored means further comprises:

a substantially continuous ring engageable with a tank of a spill container.

9. The apparatus of claim 6 further comprising:

adhesive to immovably associate colored means with respect to a base plates of the spill container.

10. The apparatus of claim 6 further comprising:

at least one bolt to immovably associate colored means with respect to a base plates of the spill container.

11. The apparatus of claim 6 wherein the colored means is positionable adjacent an opposite side of a lip of a tank of the spill container with respect to a base plates of the spill container.

12. The apparatus of claim 6 wherein the colored means is positionable adjacent an opposite side of a base plates of the spill container with respect to a lip of a tank of the spill container.

13. The apparatus of claim 6 further comprising:

a colored lid removably engageable with the spill container, wherein a color of the lid is substantially the same as a color of colored means.

14. The apparatus of claim 6 wherein colored means is at least partially positionable in a recess defined by a base plates of the spill container.

15. The apparatus of claim 6 wherein colored means is at least partially positionable in the ground.

16. The apparatus of claim 6 wherein colored means is fully disposed on a base plates of the spill container.

17. The apparatus of claim 6 wherein colored means defines an exposed colored surface substantially parallel and coplanar to a surface defined by a base plates of the spill container.

18. The apparatus of claim 6 wherein colored means is uniformly colored.

19. The apparatus of claim 6 wherein colored means is arcuately shaped to correspond to an outer surface of a base plates of the spill container.

20. In combination with an underground storage tank having a spill container defining an exposed inlet of the storage tank and a lid removably attached to the inlet, means for identifying material contained in the underground storage tank, the improvement comprising:

colored means rigidly associated with the inlet of the underground storage tank, the colored means being viewable from an exterior of the spill container with the lid attached to the inlet.

* * * * *